US005398530A

United States Patent [19]

Derman

[11] Patent Number: 5,398,530

[45] Date of Patent: Mar. 21, 1995

[54] ELECTRICAL CORD LOCKING DEVICE

[76] Inventor: Jay S. Derman, P.O. Box 949, Redondo Beach, Calif. 90277

[21] Appl. No.: 92,120

[22] Filed: Jul. 15, 1993

[51] Int. Cl.[6] ..... H01R 13/639

[52] U.S. Cl. ..... 70/58; 439/133; 70/18

[58] Field of Search ..... 70/14, 18, 61, 57, 58, 70/30, 49; 439/133, 501, 531

[56] References Cited

U.S. PATENT DOCUMENTS

| | | | |
|---|---|---|---|
| 3,841,118 | 10/1974 | Stone | 70/49 |
| 3,985,275 | 10/1976 | Allen | 70/58 |
| 4,003,228 | 1/1977 | Lievens et al. | 70/58 |
| 4,146,242 | 3/1979 | Bose | 70/58 |
| 4,157,602 | 6/1979 | Pennell | 70/18 |
| 4,750,898 | 6/1988 | Soulard | 439/133 |
| 4,938,040 | 7/1990 | Humphreys, Jr. | 70/58 |
| 5,228,319 | 7/1993 | Holley et al. | 70/58 |

*Primary Examiner*—Peter M. Cuomo
*Assistant Examiner*—Darnell M. Boucher
*Attorney, Agent, or Firm*—Monty Koslover Assoc.

[57] ABSTRACT

A device for preventing theft of any appliance having a permanently attached power or data cord, such as portable power drills, power saws, personal computers, monitors, printers and the like. The device comprises a flat clamping body member made of two mating halves, a threaded bolt element which protrudes through both body member halves and a nut member which fits on the bolt to screw down tight on the clamping body. The clamping body incorporates running alignment grooves for cupping the power or data cords and holding them tightly. Holes are provided in the clamp body and nut member allowing a wire cable to be passed through, securing the device and appliance cord to the wire cable.

2 Claims, 1 Drawing Sheet

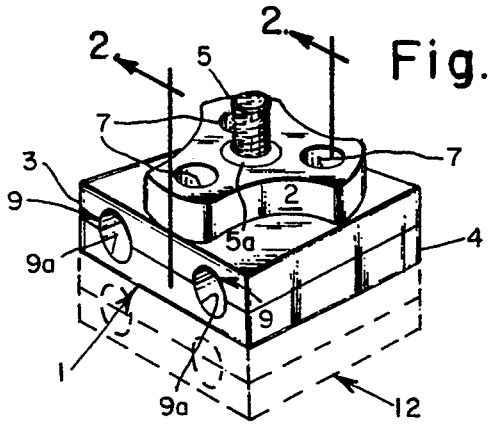
Fig. 1.
Fig. 2.
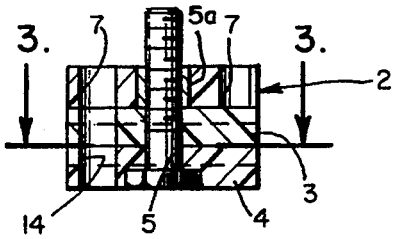
Fig. 3.
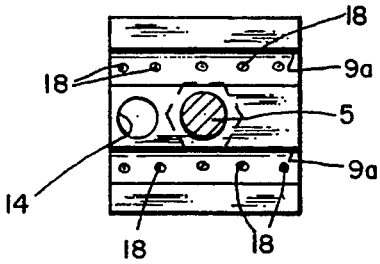
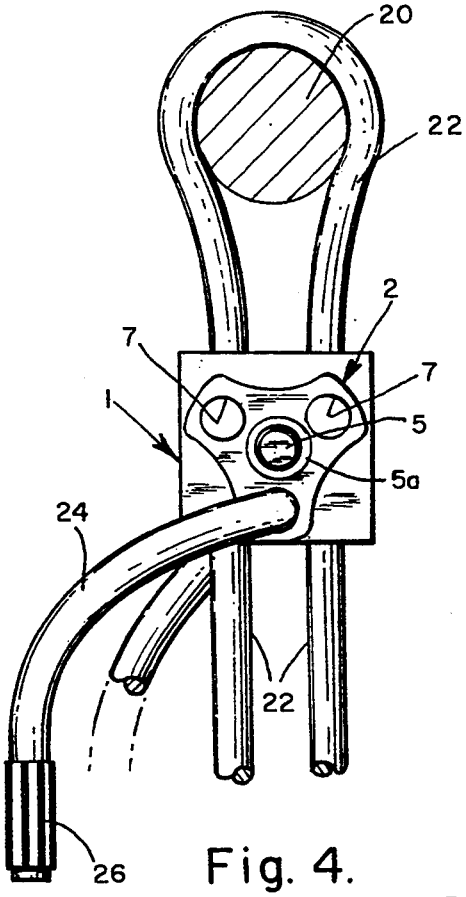
Fig. 4.
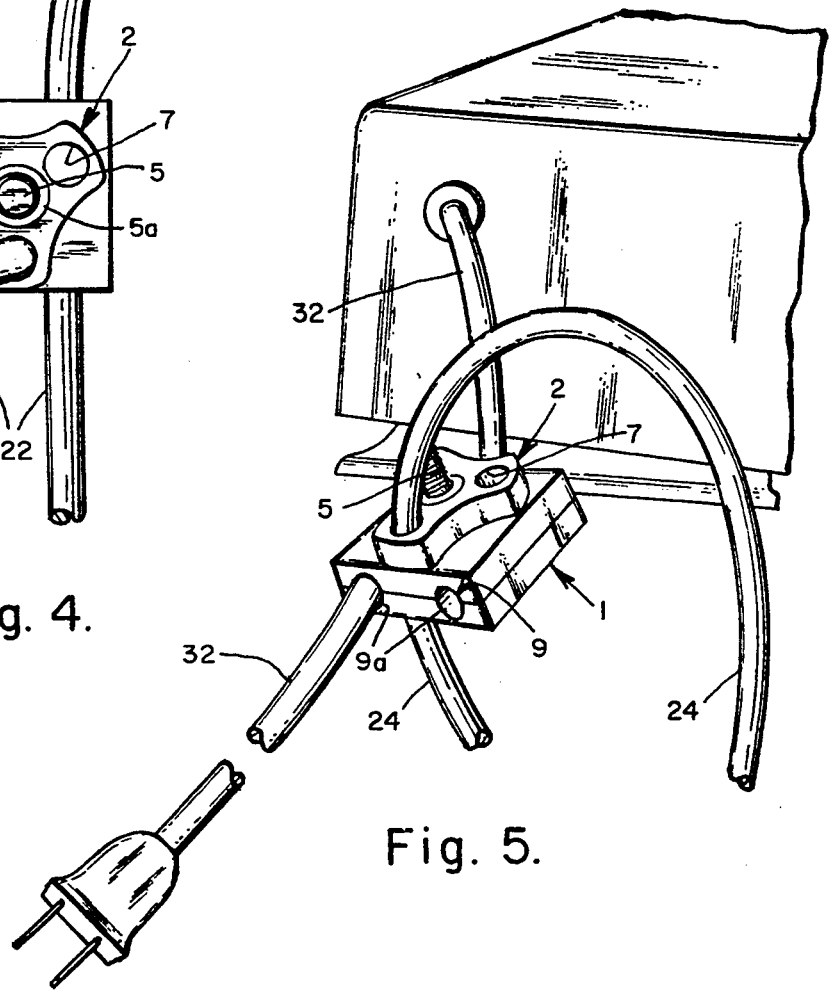
Fig. 5.

ELECTRICAL CORD LOCKING DEVICE

BACKGROUND AND SUMMARY OF THE INVENTION

This invention relates to a device useful for securing any electrical equipment or appliance having a permanently attached electrical or data cord.

There presently exists a number of devices and methods for securing equipment such as computers, display monitors and printers. Locking methods are also available for electrical appliances such as portable hand drills, power saws and the like. Patent application Ser. No. 08/063,158 now U.S. Pat. No. 5,351,507 for a "Wire Cable Locking Device" by this inventor, describes just such a device for securing electrical appliances. In the above invention, the means of fastening an electrical appliance to the locking device cord is a fastener block which incorporates holes for the device cord which in turn, is key-locked to a restraining fixture. The fastener block attaches to the given appliance by a screw.

In many other equipment locking devices, the equivalent equipment fastener block is fastened by an adhesive to the computer or other appliance. Both of the above methods for securing equipment using fastener blocks are deemed adequate. However, it is believed these methods can be improved. For example, a portable electrical hand drill and power saw each present a very small surface area for the practical attachment of a permanent fastener block. Having this block permanently attached to the appliance body may often present an inconvenience for the user. It would therefore be an improvement to have a fastening means which was not attached directly to the appliance body.

For computer equipment and the like, the attachment of fastener blocks or plates, whether by adhesive or by screw directly to the case, may present unwanted proximity to and interference with connectors, switch adjustment areas or the fan exhaust, depending on the size of the equipment. Such a situation is generally tolerated because of the need for the locking device. Furthermore, the use of adhesive-mounted fastener blocks or plates attached to the case of a computer, monitor or printer will mar its surface, which is not desirable. This situation too, can be improved by using a fastening means which is not attached directly to the computer module or monitor case. It is to the need for such improvements that this invention is primarily addressed.

Additional applications of this invention locking device are to any equipments or devices which utilize cables for securing purposes, whether electrical or not.

In accordance with the invention, the device comprises a first clamping body member, a second body member having a threaded center hole and fitting on top of the first body member, and a threaded bolt which enables the second top member to screw down and clamp on the first body member. The first body member has two halves; each half having parallel grooves sized to cup over an electrical cord, so that when the two halves are clamped together, the body member can clamp an inserted cord.

Both body members have a vertical hole transverse to the cord grooves, extending through them to allow a wire rope cable to pass through. The wire rope cable or a padlock serves to lock the device in place on the electrical cord.

The invention is small and can be placed on the electrical power cord or data cord of a PC close to its case so that it can not be easily removed by unauthorized persons without damaging the power cord or data cord. Provision is made for stacking, so that a number of the devices may be used at one location to secure a multiple number of equipments. This approach is particularly useful for securing a quantity of portable power drills, power saws and similar appliances.

Accordingly, a prime object of this invention is to provide an electrical cord locking device which enables securing electrical equipment and portable appliances by attachment to a power or data cord rather than to the equipment body.

Another object is to provide a fastener block for use with computers and the like, that will not need to be permanently fastened to the computer case, marring its surface.

Yet another object is to provide a device which can be used effectively in clamping cords or non-electrical cables as a part of other locking devices and systems.

Further objects and advantages of the present invention will become apparent from the study of the following portion of the specification, the claims and the attached drawings.

BRIEF DESCRIPTION OF THE DRAWINGS

FIG. 1 is a generally perspective view showing the preferred embodiment of the present invention, and indicating provisions for stacking multiple devices;

FIG. 2 is an elevation cross-section view of the present invention device taken along line 2—2 of FIG. 1;

FIG. 3 is a top cross-section view of the present invention device taken along line 3—3 of FIG. 2, particularly showing detail of the bottom half of the clamping body member;

FIG. 4 is a top view of the present invention device being used to secure a cable which is looped around a fixture, and showing how a wire cable passing through the device, locks it in place; and FIG. 5 is a perspective view of the present invention device attached to the power cord of an electrical appliance and secured by a wire cable passing through the device.

DESCRIPTION OF THE PREFERRED EMBODIMENT

Referring particularly to the drawings, there is shown in FIG. 1 a perspective view of a preferred embodiment of the electrical cord locking device 1, according to the present invention. In this view, the device 1 is shown stacked on a second device 12, which is indicated by dashed lines.

The device 1 comprises a nut member 2, an upper clamp body member 3, a lower clamp body member 4 and a threaded bolt 5. The threaded bolt 5 is the means by which the nut member 2 is screwed down tight against the clamp body members 3, 4, holding them together. The nut member 2 is a flat slab piece incorporating a threaded hole insert 5*a* on its center axis adapted to fit the threaded portion of the bolt 5, and one or more non-threaded vertical holes 7 which are located around its circumference. These non-threaded holes 7 are sized to allow a wire cable to pass through. The thickness and shape of the nut member 2, are selected for convenience in grasping with the fingers, so that it may be comfortably finger-tightened on the bolt 5. The nut member 2 shown in FIG. 1 is an example of an acceptable nut member shape.

Referring again to FIG. 1, it is seen that both the upper and lower clamp body members 3, 4, are flat slab pieces of rigid material of identical size and shape. Both the clamp body members include one or more running alignment grooves 9*a* which are sized to cup over a power or data cord, so that when placed one clamp body member on top of the other, the grooves 9*a* form through holes 9 which are parallel to the upper and lower clamp surfaces.

Refer now to FIGS. 2 and 3 which show cross-sectional views of the device. FIG. 2 is a cross-section view taken along line 2—2 of FIG. 1 and FIG. 3 is a plan cross-section view taken along line 3—3 of FIG. 2. These views depict the inner arrangement of the device. A first hole is bored through the center of both clamp body members 3,4 to accommodate the body of the bolt 5. A shaped recess is formed in the bottom surface of the lower clamp body member 4 to seat the head of the bolt 5 and prevent it from rotating.

A second hole 14 is cut through both clamp body members vertically, located between the cord grooves 9*a*, and at a radius from the bolt 5 hole such that any one of the non-threaded holes 7 around the circumference of the nut member 2 can be aligned with the second hole 14. Both the second hole 14 and the nut member hole 7 are sized to allow a wire cable to be passed through.

The power or data cords which pass between the clamp body members must be held tightly. To achieve this a crimping means is provided along the bottom of each of the grooves 9*a* in the upper and lower clamp body members 3, 4. The crimping means consists of a number of projections 18 spaced along the bottom of the grooves 9*a* and extending upwards. These projections 18 will push into a power or data cord that lays in the groove, crimping the cord and gripping it tightly.

The electrical cord locking device 1 is capable of being stacked in multiple quantities of two or more as illustrated in FIG. 1. In order to do this, all that is required is for bolt 5 to be made long enough to go through two or more sets of clamp body members and a nut member 2. The bolt 5 will then come in several lengths, suitable for one, two or more stacked devices.

For electrical safety, it is recommended that the device, except for the bolt, be made of a rigid plastic material.

FIGS. 4 and 5 illustrate two of the several ways in which the invention device can be used. In FIG. 4, the device is shown in use as a cable clamp. A cable 22 is looped around a post 20 and passed through the clamp grooves in the device 1. The device nut member 2 is then tightened on the threaded bolt 5 and a fastening cable 24 is passed vertically through the device nut member hole 7 aligned with the clamp body holes 14, preventing the nut member from being unscrewed and locking the device in place.

FIG. 5 illustrates a typical use of the device with a portable appliance or a PC. Here the device 1 is shown clamped on a power cord 32 which is attached to the back of the PC. As shown in FIG. 5, a fastening cable 24 is passed through the device nut member 2 hole aligned with the clamp body holes 14 and through the device, locking the device in place. It should be noted that in both of the illustrated applications, a padlock could be used in the place of a fastening cable 24 where this is considered to accomplish the security function.

The device 1 can be positioned on the power cord very close to the appliance case, making it difficult to remove the appliance by cutting the power cord, since the device would still be attached to the appliance case. If the power of data cord was cut close to the appliance case, this would likely ruin a thiefs' chances of selling the stolen item, thus deterring him from such an action.

Finally, the device application of securing an electrical appliance by its power or data cord is intended as the major application of this invention. A secondary application is the device use as a cable clamp in conjunction with present security locking systems that; employ cables. However, because the device may be made very small and easy to fit in equipment spaces, it may also be used as a wipe harness clamp, or even for holding hydraulic system tubing in place. Other possible applications will no doubt be considered as the device becomes well known and available.

From the foregoing description, it is believed that the preferred embodiment achieves the objects of the present invention. Alternative embodiments and various modifications may be apparent to those ski lied in the art. These alternatives and modifications are considered to be within the spirit and scope of the present invention.

Having described the invention, what is claimed is:

1. A device for locking electrical appliances by their power or data cords, comprising:

a clamping body having an upper body member and a lower body member, each said body member having flat, parallel outer faces and having a first hole at center of said faces, sized to allow a bolt element to pass through; said clamping body having a second hole extending vertically through both said body members adapted to allow a wire rope cable to pass through;

first means including a threaded bolt element running perpendicular through the center of the plane of both body members adapted to permit both body members to be clamped and aligned over a power or data cord; and second means including a nut member having a threaded hole insert on its center axis adapted to fit the threaded portion of said bolt element, enabling said nut member to be tightened down on said clamping body members; said clamping body including third means for receiving and surrounding a portion of an appliance power or data cord; said nut member including fourth means for preventing said nut member from being rotated off said threaded bolt element to remove said device from a power or data cord;

said fourth means for preventing said nut member from being rotated including a multiplicity of holes located around its circumference, parallel with its central axis defined by said threaded hole insert, said holes being located at a radius selected to coincide with the radial location of said second hole extending through said clamping body members, each said nut member hole being adapted to allow a wire cable to pass through; said nut member, when being rotated on said threaded bolt element until tight and one of its radial holes is aligned with said clamping body second hole forming an extended second hole, having a wire cable inserted through said extended second hole which prevents said nut member from being rotated.

2. The device as recited in claim 1 wherein said threaded bolt element has a length selected to pass through said first hole in each clamping body of a multiplicity of stacked clamping bodies and a single nut member, thus permitting stacking of multiple units of said device.

* * * * *